United States Patent [19]

Richards

[11] Patent Number: 4,624,328

[45] Date of Patent: Nov. 25, 1986

[54] IN-SHAFT DRILLING APPARATUS FOR RECOVERY OF GAS FROM SUBTERRANEAN FORMATIONS

[75] Inventor: Walter L. Richards, Huntington Beach, Calif.

[73] Assignee: Methane Drainage Ventures, Placentia, Calif.

[21] Appl. No.: 773,185

[22] Filed: Sep. 6, 1985

Related U.S. Application Data

[62] Division of Ser. No. 618,473, Jun. 8, 1984.

[51] Int. Cl.[4] ..... E21B 7/00

[52] U.S. Cl. ..... 175/78; 175/86

[58] Field of Search ..... 175/62, 78, 79, 81, 175/86

[56] References Cited

U.S. PATENT DOCUMENTS

| | | | |
|---|---|---|---|
| 2,325,565 | 7/1943 | Williams | 175/62 |
| 2,783,972 | 3/1957 | Fehlmann | 175/78 |
| 2,810,547 | 10/1957 | Fehlmann | 175/86 |
| 2,889,137 | 6/1959 | Walker | 175/78 |
| 3,379,264 | 4/1968 | Cox | 175/86 |
| 3,547,211 | 12/1970 | Christensen et al. | 175/86 |
| 4,494,617 | 1/1985 | Snyder | 175/86 |

*Primary Examiner*—Stephen J. Novosad
*Assistant Examiner*—Bruce M. Kisliuk
*Attorney, Agent, or Firm*—Walter A. Hackler

[57] ABSTRACT

In shaft drilling apparatus for recovery of gas from subterranean formations includes a platform adapted for being suspended by a cable and rotated within a generally vertical shaft in the earth. Drilling and stabilizing apparatus are provided and disposed on the platform for drilling boreholes into the subterranean seams containing gas and rigidly supporting the platform within the generally vertical shaft during the drilling of the boreholes. A liquid-solids-gas separator is provided which is disposed on the platform and in an operative relationship with the drilling apparatus for separating solid cuttings and gas from the drilling efflux. Apparatus for enabling fresh air to be circulated to and from the platform is provided and includes a curtain wall disposed along the diameter of the generally vertical shaft. The platform is disposed on one side of the curtain wall during circulation of air to and from the platform.

8 Claims, 7 Drawing Figures

IN-SHAFT DRILLING APPARATUS FOR RECOVERY OF GAS FROM SUBTERRANEAN FORMATIONS

This application is a division, of application Ser. No. 618,473, filed June 8, 1984.

BACKGROUND

The present invention is generally related to the collection of gas from subterranean formations, and more particularly is directed to a method for collecting gas from subterranean formations having a plurality of spaced-apart seams containing the gas.

Coal seams are commonly found in a spaced-apart relationship in subterranean formations and generally contain therein a significant amount of methane gas which escapes therefrom as the coal is mined.

In conventional coal mining, the released methane gas must be vented in order to provide a safe working environment for workers employed in the mining operation.

The methane gas is hazardous from a health standpoint, as it is poisonous, and also from a safety standpoint, as it forms combustible mixtures with oxygen.

Although a considerable amount of effort has been put forth to ventilate coal mines to remove methane gas, such as air dilution systems within the mine and the drilling of holes within the coal seams in advance of mining to draw off the methane, littlle has been done on a commercial basis to extract and collect gases, such as methane, from underground seams without the subsequent mining of the seams to remove coal.

co-pending U. S. applications, entitled, "Multiple Level Methane Drainage Shaft Method," Ser. No. 420,149, filed on Sept. 20, 1982, now U.S. Pat. No. 4,452,489 and "Multiple Level Methane Drainage Method," Ser. No. 609,473, filed on May 11, 1984 disclose a method for the recovery of methane gas from underground or subterranean formations, irrespective of later mining of the seams for the coal content.

These methods are important in that they are suitable for collecting methane gas from coal seams in which the thickness of the coal seams is significantly less than that needed for economic commercial mining of the coal from the coal seams.

These methods, however, require extensive underground excavation in order to establish a methane gas collection system within a plurality of spaced-apart coal seams.

Needless to say, such excavation is expensive and time-consuming. The present method and apparatus is directed to the recovery of gas from underground formations having a plurality of spaced-apart seams containing gas. However, little excavation is necessary beyond that of the sinking of a generally vertical shaft from the earth's surface and intersecting a plurality of these seams.

The apparatus of the present invention enables the drilling of a plurality of horizontal holes in a plurality of the subterranean spaced-apart seams and the collection of gas therefrom.

In addition, the thickness of the seam is not a limitation to the utilization of the method and apparatus of the present invention.

SUMMARY OF THE INVENTION

Apparatus, in accordance with the present invention, for use with the method of the invention, generally includes a platform adapted for being suspended by a cable within a generally vertical shaft in the earth. More particularly, the platform may be adapted for rotation within the generally vertical shaft.

Drilling means are provided and disposed on the platform for drilling boreholes into the subterranean seams containing gas as well as stabilizing means for rigidly supporting the platform within the generally vertical shaft during the drilling of the boreholes. The stabilizer means is operative for releasing the platform to enable rotation of the platform and movement of the platform from one spaced-apart subterranean seam to another.

Liquid-solids-gas separation means is provided which is disposed on the platform and in an operative relationship with the drilling means, for separating solid cuttings and gas from the drilling efflux. Means for enabling fresh air to be circulated to and from the platform is provided which includes a curtain wall disposed along the diameter of the generally vertical shaft, with the platform being disposed on one side of the curtain wall during circulation of air to and from the platform.

BRIEF DESCRIPTION OF THE DRAWING

The advantages and features of the present invention will appear from the following description considered in conjunction with the accompanying drawings, in which.

DETAILED DESCRIPTION

Figure 1:
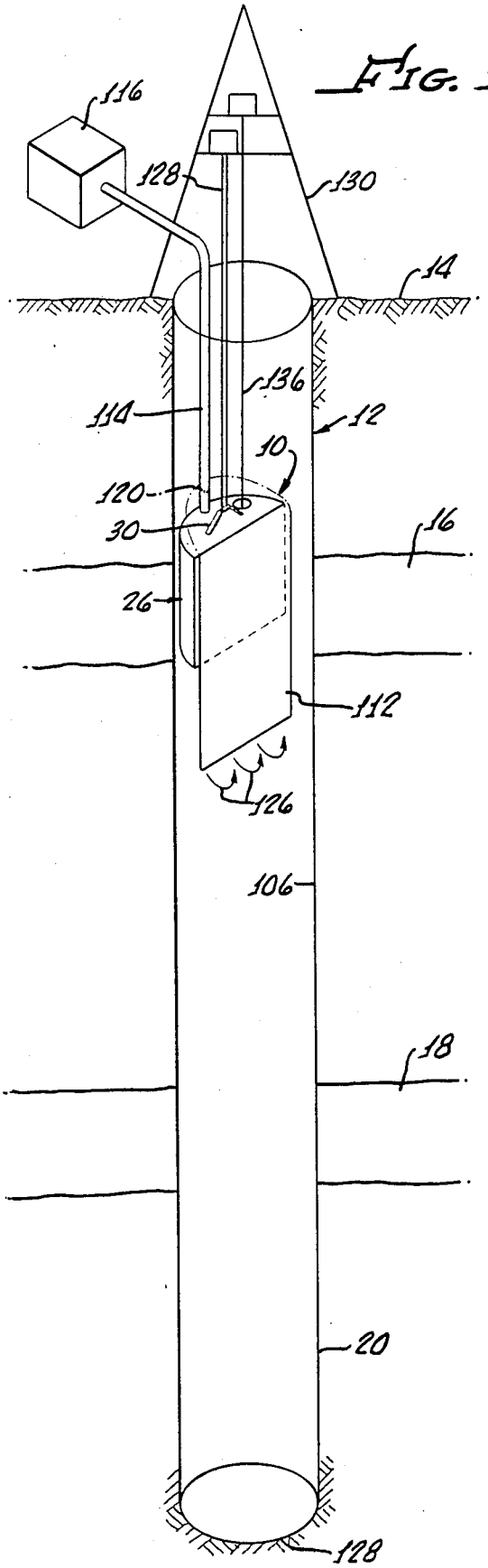
FIG. 1 is a perspective view of apparatus for drilling boreholes from a generally vertical shaft in subterranean formations in accordance with the present invention, showing a generally circular shaft drilled through a plurality of subterranean seams and showing a generally semi-circular platform, suspended by a cable within the shaft, which can be raised and lowered from one subterranean seam to another and rotated within the shaft, and an air curtain disposed around the platform for enabling circulation of air to and from the platform.

Turning now to FIG. 1, there is shown apparatus 10 for drilling boreholes from a generally vertical and circular shaft 12, which may have a diameter of about 18 feet, drilled, or excavated, from the earth's surface 14 to a depth sufficient to interesect a plurality of coal seams 16, 18 and below the lowest seam 18, from which gas is to be collected, to create a sump 20, as will be hereinafter described in greater detail.

It should be appreciated that while only two spaced-apart coal seams 16, 18 are shown in FIG. 1, a greater number of coal seams may be present.

The number of coal seams, or levels, useful for producing gas, is dependent upon the number of coal seams present, the thickness of the coal seams, and the amount of gas contained therein as may be predetermined by standard sampling techniques.

It should be additionally appreciated that the thickness of the seams 16, 18 as shown in FIG. 1, are not drawn to scale, and may have a thickness of less than approximately 3 feet.

The suitability of a given seam for the drilling of holes thereinto and subsequent collection of methane gas is determined in part upon the amount of methane in the particular coal seam. It is apparent that a thicker coal seam would be necessary when coal contained therein includes a relatively small amount of methane per cubic foot than would be the case for a seam in which the methane concentration is relatively high.

Figure 2:
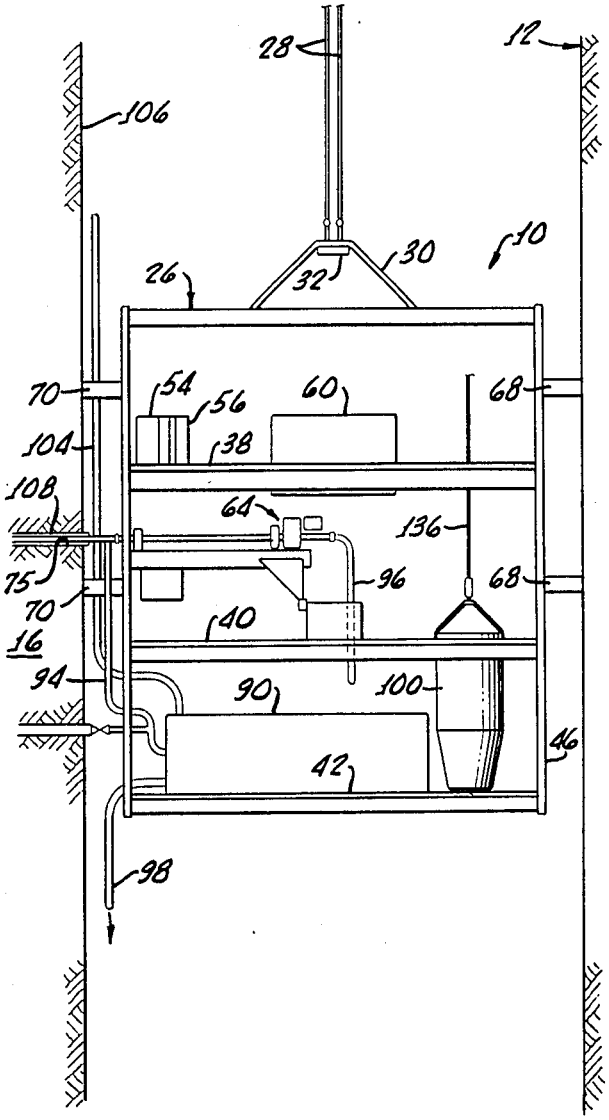
FIG. 2 is an elevation view of the platform showing three levels.

More clearly shown in the elevation view of FIG. 2, apparatus 10, generally includes a platform 26, having a generally semi-circular cross-section which is adapted for being suspended by a cable 28 within the shaft 12, by means of a bracket 30 and may be further adapted for rotation within the shaft 12 by a swivel coupling 32 between the bracket 30 and the cable 28.

The platform 28 is composed of three levels, namely, an upper level 38, (FIG. 3) a middle level 40, (FIG. 4) and a lower level 42, (FIG. 5) interconnected by a side wall 46.

Although many configurations may be utilized for support equipment, the upper level 38, in accordance with the present invention, supports a hydraulic oil pump 52, electrical control systems 54, 56, and a rack 60 for the storage of drill pipe (not shown), said rack being operative for supporting the pipe and for delivering the pipe from the upper level 38 to the drill 64 disposed on the middle level 40.

The drill 64 may be conventional in design for drilling about 3 inch diameter boreholes into the coal seams 16, 18 and may be mounted between a pair of rails 66 to enable the drill to rotate thereon about the axis of the shaft for drilling of boreholes without rotation of the platform.

A stabilizing system, comprising a pair of standoff jacks 68, 70 and a retractable stabilizing beam 72 are provided for rigidly supporting the platform 26 within the vertical shaft 12 during the drilling of boreholes 78, 80, 82, 84 into the subterranean seams 16, 18.

Figure 3:
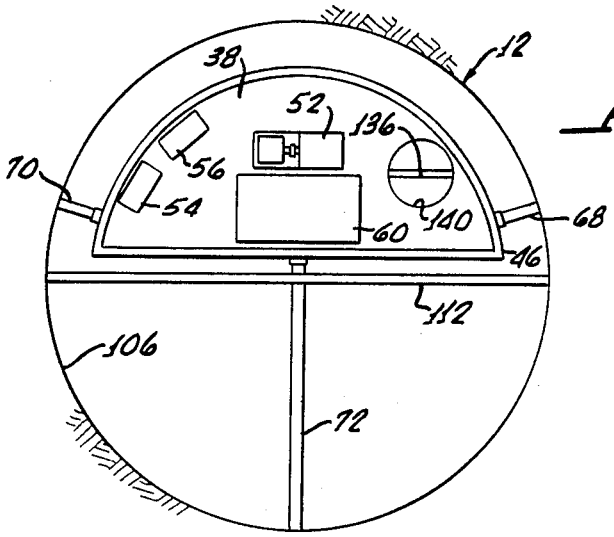
FIG. 3 is a plan view of an upper level of the platform generally showing drill pipe storage and support equipment.

The standoff jacks may be retractable or foldable from an extended position, shown in FIG. 3, to a retracted position (not shown) in which they may lie adjacent the platform side wall 46.

The retractable, stabilizing beam 72 may comprise a hydraulic piston, or the like, utilizing the hydraulic power available on the platform, or it may be mechanically operated.

Disposed on the lower level 42 is a liquid-solidsgas separation system 90 in an operative relationship with the drill 64 via a conduit 94, for receiving efflux from the drilling operation, separating methane gas and solid cuttings therefrom and returning the water base cutting fluid to the drill 64 via a conduit 96. The liquid-solids-gas separation system 90 may be of any suitable type well known in the art.

Cuttings from the liquid-solids-gas separation system 90 may be dropped into the sump 20 by a conduit 98.

In certain circumstances, where it may not be advisable to dump cuttings into the sump 20, it may be necessary to collect the cuttings separately for other disposal. Such cuttings, or refuse, may be subsequently drained of water and removed to the surface for other disposal by means of a bucket 100.

Methane gas separated from the efflux is passed to a gas riser 104 attached to a wall 106 of the shaft 12. The gas riser 104 forms, in part, a conduit system, for collecting gas from the boreholes and conducting the gas to the earth's surface.

As will be discussed hereinafter in connection with the method of the present invention, a liner 108 may be inserted in each of the boreholes 78, 80, 82, 84 and connected to the gas riser 104 to collect and pass the methane gas to the earth's surface.

It should be appreciated that the liners 108 referred to herein may be perforated, as is well known in the art, or solid, such as conventional standpipe types which are grouted into the boreholes 78, 80, 82, 84 for a short distance. Either may be used, in accordance with the present invention, depending on the coal seam.

To enable fresh air to be circulated to and from the platform, a curtain wall 112 comprising Brattice cloth, available from Peabody ABC Company, may be disposed along the diameter of the shaft 12 in the vicinity of the platform 26 (see FIG. 1). Positive ventilation may be provided via means of a tube 114 extending from the earth's surface to a level just above the platform 26 through which fresh air is pumped via an air fan 116.

The Brattice cloth curtain 112 is secured around the outside of an end 120 of the tube 114 and is of sufficient length to extend below the lower level 42 of the platform 26, so that incoming fresh air will sweep past the men and equipment on the platform 26 and return on the opposite side of the curtain 112, as shown by the arrows 126.

In order to ensure that the sump does not collect methane gas, the curtain 112 may be extended to a point near the bottom 128 of the sump to enable the air flow to eliminate the collection of methane gas in the sump 20.

Alternatively, a negative fresh air flow system (not shown in FIG. 1) may be provided in which fresh air enters into the entire shaft 12 at the earth's surface 14 and the tube 114 extends to a point above, yet near the bottom 128 of the sump 20 for the return of the gas therethrough. In this manner, the curtain 112 is not necessary.

However, a hole (not shown) may be provided through the platform 26, in order to incorporate the passage of the tube 114 therethrough to the sump 20. Such a hole through the platform 26 may not be required if the tube 114 is affixed to the platform away from drilling such as on the shaft wall 106 or the stabilizing beam 72. In such case, it will only be necessary to avoid entanglement of tube 114 during and after necessary vertical or rotary movement of the platform 26 as may be necessary for drilling.

The platform 26 may be suspended by the cable 28 from a conventional derrick 130 or the like, and the bucket 100 may be suspended via a second cable 136 from the earth's surface 14, utilizing the derrick 130 to provide a means for transferring men and supplies to and from the platform 26. Openings 140, 142, respectively, in the upper and middle levels 38, 40 enable movement of the bucket to any desired level within the platform 26.

Figure 5:
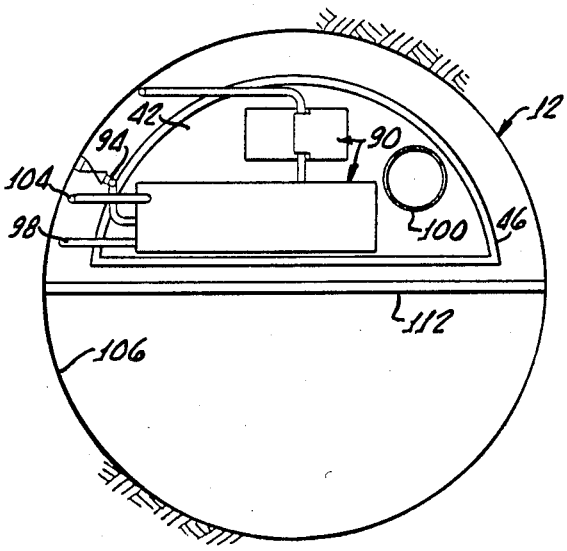
FIG. 5 is a plan view of a lower level of the platform generally showing liquid-solids-gas separation equipment.
Figure 6:
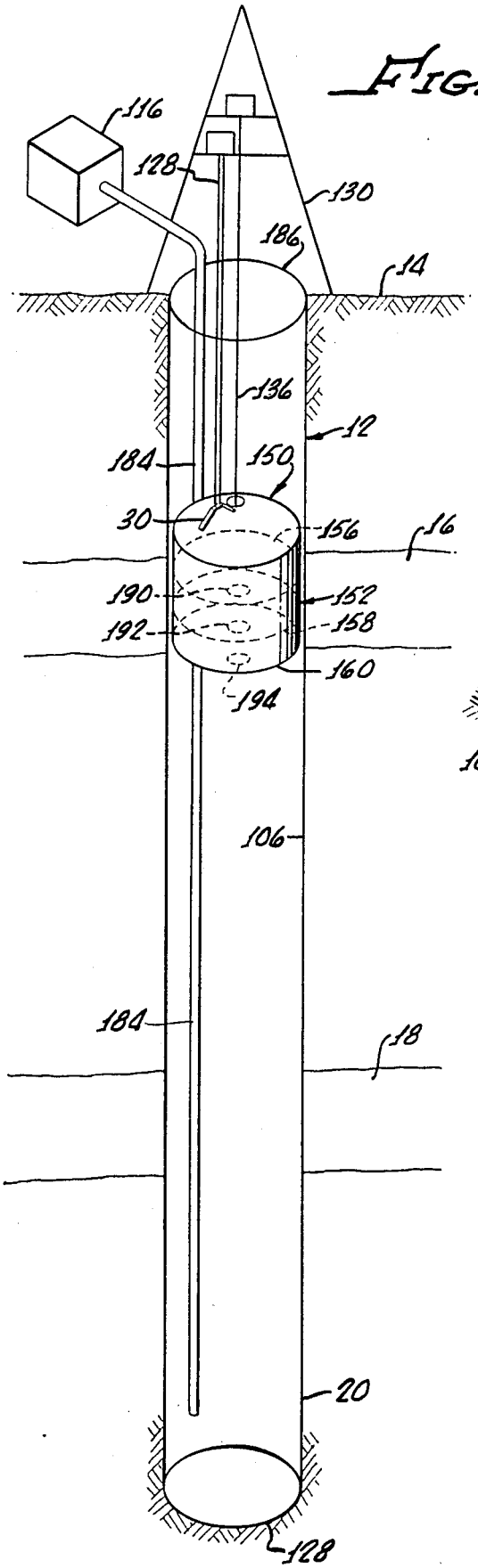
FIG. 6 is a perspective view of an alternative embodiment of apparatus in accordance with the present invention, showing a generally circular drilling platform suspended in a generally vertical shaft; and, FIG. 7 is a plan view showing a middle level of the platform shown in FIG. 6.
Figure 7:
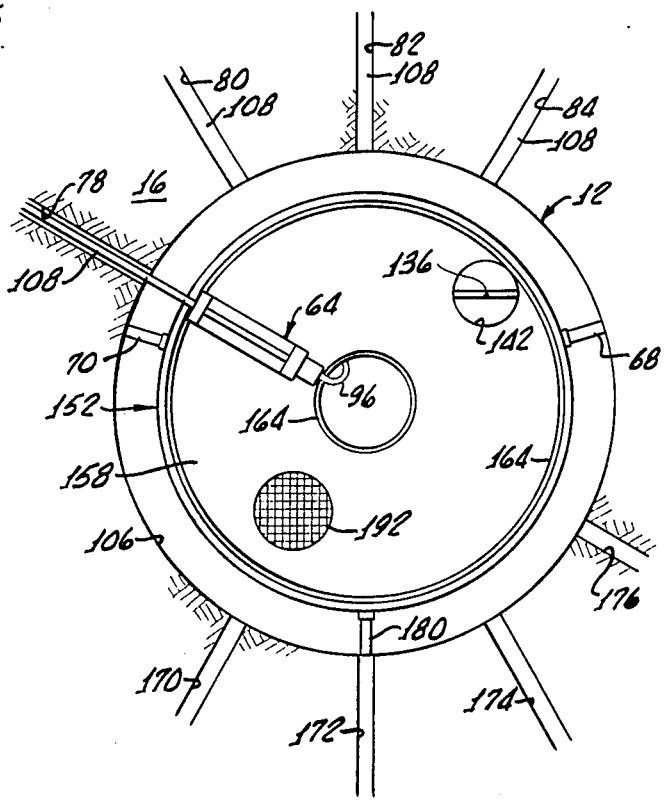

Turning now to FIG. 6 and 7, there is shown an alternative embodiment, or appartus 150, in accordance with the present invention. Reference numbers shown in FIGS. 6 and 7, which are the same as in FIGS. 1–5, refer to identical or similar items.

As shown in FIG. 6, apparatus 150 may include a platform 152 having a circular cross-section. This allows greater room on each level 156, 158, 160 for the equipment shown in FIGS. 1–5.

In addition, as more clearly shown in FIG. 7, the middle level 158 includes a pair of rails 164 for supporting the drill 64, which extend around the inside and outside perimeters of the middle level 158 to enable the drill to be effectively rotated about the shaft 12 axis for the drilling of radially spaced-apart boreholes 78, 80, 82, 84, 170, 172, 174, 176 without the necessity of rotating the platform 152, or retraction of the beams 68, 72 or jack 180.

With the use of the platform 150, a negative fresh air system is anticipated as briefly mentioned in connection with the platform 26.

In the negative fresh air system, a tube 184 extends to a point just above the bottom 128 of the sump 20 for withdrawing air entering the top 186 and methane gas collecting therein.

Grids 190, 192, 194 may be provided in each of the levels 156, 158, 160 to enable circulation and flow of air through the platform 150.

A method for collecting methane gas from subterranean formations having a plurality of spaced-apart coal seams 16, 18, utilizing the apparatus of the present invention, includes the steps of drilling, or excavating, a generally circular shaft 12 from the earth's surface 14 to a depth sufficient to intersect the coal seams 16, 18 and therebelow to form a sump 20.

Upon completion of the shaft 12, the platform 26 is inserted and lowered to a position adjacent a coal seam 16 containing methane gas, suitability of the seam 16 for the recovery of gas being determined prior to drilling of the shaft 12 by means of standard sampling and coring techniques.

After positioning the platform at the coal seam 16, the standoff jacks 68, 70 are extended and the retractable stabilizing beam 72 extended to stabilize the platform 26 within the shaft 12. A generally horizontal hole 78 is then drilled into coal seam 16.

Alternatively, although not shown in the Figures, the platform may be disposed above or below the coal seam 16, 18 and boreholes drilled into the overlaying or underlaying coal seam from the platform 28. Factors relating to whether boreholes are drilled in this manner includes the distance between the seams, the thickness of the seams, as well as rock mechanics considerations.

In addition, the drilling of slant holes from the platform 28 into a coal seam may allow simultaneous excavation and working of the coal seam.

It should also be appreciated that the term "generally horizontal boreholes," used to describe the drilling herein, means the drilling of boreholes within the coal seams. Most coal seams generally are horizontal, however, they may move up and down in an undulating pattern beneath the earth's surface 14. Hence, each of the horizontal holes 78, 80, 82, 84 must change in course to remain within the coal seam at all times.

A liner may be disposed in each generally horizontal hole and the solid cuttings from the drilling of the generally horizontal hole 78 may be dropped into the sump 20.

In this manner, the sump eliminates the need for a conveyor or lift system, such as the bucket 100, to convey solid efflux from the drilling operation to the earth's surface.

Following the drilling of the boreholes 78, the standoff jacks 68, 70 and retractable stabilizing beam are disengaged from the shaft wall 106 to enable rotation of the platform within the shaft 12 at the coal seam 16. The standoff jacks and retractable stabilizing beams are then extended and a generally horizontal second borehole 80 is drilled into the seam 16 and a second liner inserted thereinto.

Figure 4:
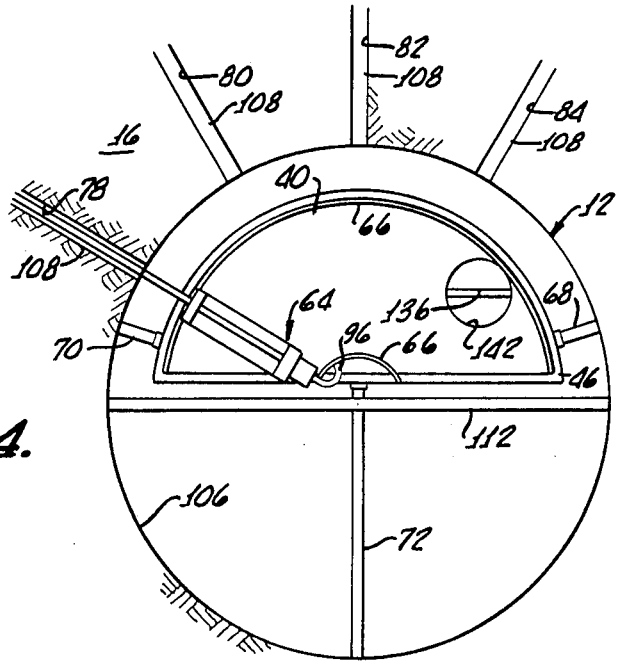
FIG. 4 is a plan view of a middle level of the platform showing a drill, stabilizing means for supporting the platform during the drilling of boreholes and a plurality of generally horizontal boreholes drilled into a subterranean seam.

It is apparent from FIG. 4, that it is not necessary to rotate platoform 26 until several holes are drilled from one side of the platform 26. These multiple holes are drilled by simple radial movement of the drill 64 in an arc about the rails 66. Alternatively, with the use of the platform 152, no rotation is required at a selected seam in order to drill radially spaced-apart boreholes, 78, 80, 82, 84, 170, 172, 174, 176 in a 360 degree pattern at the selected seam.

Cuttings from the drilling of the second borehole 80 may be dropped into the sump 20 and upon completion of the second hole 80 and insertion of the liner 108, the platform 26 is intermittently rotated within the shaft 12 at the coal seam 16 and additional horizontal holes 80 to 84 are drilled into the seam 16 and liners placed therein to create a plurality of radially separated generally horizontal holes 78, 80, 82, 84 in the coal seam 16.

Thereafter, the retractable stabilizing beam 72 is retracted and the standoff jacks 68 folded to enable moving the movable and rotatable platform 26 to another of the seams 18 containing gas and the drilling and rotating operation at each of the coal seams is repeated.

The liners 108 are connected to the gas riser 104 for transferring the methane gas to the surface.

It is to be appreciated that, although there has been described hereinabove, a specific apparatus and method for collecting gas from subterranean formations, in accordance with the present invention, for the purpose of illustrating the manner in which the invention may be used to advantage, the invention is not limited thereto. Accordingly, any and all modifications variations or equivalent methods and apparatus which may occur to those skilled in the art, should be considered to be within the scope of the invention as defined by the appended claims.

What is claimed is:

1. Apparatus for drilling boreholes from a generally vertical shaft into a plurality of spaced-apart subterranean seams containing gas comprising:

a platform adapted for being suspended by a cable within a generally vertical shaft in the earth and further adapted for rotation within said generally vertical shaft;

drilling means, disposed on said platform, for drilling boreholes into subterranean seams containing gas;

stabilizing means for rigidly supporting said platform within said generally vertical shaft during the drilling of boreholes into subterranean seams containing gas, said stabilizing means being operative for releasing said platform to enable rotation of the platform and movement of the platform from one spaced-apart subterranean seam to another; and, means comprising a curtain wall disposed along a diameter of the generally vertical shaft, for enabling fresh air to be circulated to and from the platform means, said platform being disposed on one side of said curtain wall during circulation of air to and from the platform.

2. The apparatus of claim 1 wherein the means for enabling fresh air to be circulated to and from the platform comprises a curtain wall disposed along a diameter of the generally vertical shaft, said platform being disposed on one side of said curtain wall during circulation of air to and from the platform.

3. The apparatus of claim 2 further comprising liquid-solids-gas separation means, disposed on said platform and in an operative relationship with said drilling means, for separating solid cuttings and gas from drilling platform.

4. Apparatus for drilling boreholes from a generally vertical shaft having a sump into a plurality of spaced-apart subterranean seams containing methane gas comprising:

a platform having a generally semicircular cross-section and adapted for being suspended by a cable within a generally vertical shaft in the earth and further adapted for rotation with said generally vertical shaft;

drilling means disposed on said platform for drilling boreholes into subterranean seams containing gas;

stabilizing means for rigidly supporting said platform within said generally vertical shaft during the drilling of boreholes into subterranean seams containing gas, said stabilizer means being operative for releasing said platform to enable rotation of the platform and movement of the platform from one spaced-apart subterranean seam to another;

liquid-solids-gas separation means, disposed on said platform and in an operative relationship with said drilling means, for separating solid cuttings and gas from drilling efflux; and, means for enabling fresh air to be circulated to and from the platform and for enabling air flow to substantially eliminate collection of methane gas in the sump, said last-mentioned means including a curtain wall disposed along a diameter of the generally vertical shaft and extending from the platform to a point near the bottom of the sump, said platform being disposed on one side of said curtain wall during circulation of air to and from the platform.

5. Apparatus for drilling boreholes from a generally vertical and circular shaft into a plurality of spaced-apart subterranean seams containing gas comprising:

a platform having a generally semicircular cross-section and adapted for being suspended by a cable within a generally vertical and circular shaft in the earth and further adapted for rotation with said generally vertical and circular shaft;

drilling means disposed on said platform for drilling boreholes into subterranean seams containing gas;

stabilizing means for rigidly supporting said platform within said generally vertical shaft during the drilling of boreholes into subterranean seams containing gas, said stabilizer means being operative for releasing said platform to enable rotation of the platform and movement of the platform from one spaced-apart subterranean seam to another;

liquid-solids-gas separation means, disposed on said platform and in an operative relationship with said drilling means, for separating solid cuttings and gas from drilling efflux;

means for providing fresh air to the platform;

separator means for circulating the fresh air within the shaft and about the platform to substantially prevent methane gas from entering the platform area, said separator means including a curtain wall disposed along a diameter of the generally vertical shaft, said platform being disposed on one side of said curtain wall during circulation of air to and from the platform; and, bucket means separately suspended from the earth's surface for transferring men and supplies to and from the platform.

6. Apparatus for drilling boreholes from a generally vertical and circular shaft having a sump into a plurality of spaced-apart subterranean seams containing methane gas comprising:

a platform adapted for being suspended by a cable within a generally vertical shaft in the earth;

drilling means mounted on said platform for drilling boreholes into subterranean seams containing gas, said drilling means being mounted for rotation on said platform;

stabilizing means for rigidly supporting said platform within said generally vertical shaft during the drilling of boreholes into subterranean seams containing gas, said stabilizer means being operative for releasing said platform to enable movement of the platform from one spaced-apart subterranean seam to another; and, means for providing fresh air to the platform; and, separator means for circulating the fresh air within the shaft and about the platform to substantially prevent methane gas from entering the platform area.

7. The apparatus according to claim 6 wherein the means for providing fresh air to the platform comprises a tube extending from the earth's surface to a level proximate and above the platform and the separator means comprises a curtain secured around an end of said tube and extending below the platform to enable the fresh air to sweep downwardly past the platform on one side of the curtain and to return upwardly on another side of the curtain.

8. The apparatus according to claim 7 wherein the separator means is further operative for substantially eliminating collections of methane gas in the sump, said separator means curtain extending from the tube end to a point proximate the bottom of the shaft.

* * * * *